United States Patent [19]

Webster

[11] Patent Number: 4,672,335

[45] Date of Patent: Jun. 9, 1987

[54] PRINTED CIRCUIT WIRING BOARD HAVING A DOPED SEMI-CONDUCTIVE REGION TERMINATION

[75] Inventor: Harold F. Webster, Scotia, N.Y.

[73] Assignee: General Electric Company, Schenectady, N.Y.

[21] Appl. No.: 754,883

[22] Filed: Jul. 15, 1985

[51] Int. Cl.[4] ..... H01P 1/24

[52] U.S. Cl. ..... 333/22 R; 338/216; 338/314; 357/51

[58] Field of Search ..... 333/22 R, 81 A, 246, 333/238; 357/51; 338/216, 254, 260, 307, 308, 311, 314, 319, 320

[56] References Cited

U.S. PATENT DOCUMENTS

| | | | |
|---|---|---|---|
| 3,150,325 | 9/1964 | Blattner | 333/204 X |
| 3,432,792 | 3/1969 | Hatcher, Jr. | 338/260 X |
| 3,541,474 | 11/1970 | Holton | 333/22 R |
| 3,911,382 | 10/1975 | Harth et al. | 333/238 X |
| 4,383,227 | 5/1983 | de Ronde | 333/22 R X |

FOREIGN PATENT DOCUMENTS

| | | | |
|---|---|---|---|
| 1148290 | 5/1963 | Fed. Rep. of Germany | 333/238 |
| 2164205 | 7/1973 | Fed. Rep. of Germany | 333/22 R |
| 0076728 | 7/1978 | Japan | 333/22 R |

*Primary Examiner*—Eugene R. LaRoche
*Assistant Examiner*—Benny Lee
*Attorney, Agent, or Firm*—Marvin Snyder; James C. Davis, Jr.

[57] ABSTRACT

A matched load for an unloaded terminating end of a signal transmission line on a printed circuit wiring board avoids reflecting pulses back down the line. A non-reflective attenuation region is provided under the unloaded terminating end, such region being wedge-shaped and doped to a reduced resistivity, and situated in the silicon substrate of the board. Data pulses at the unloaded terminating end of the transmission line, modulated at the selected operating frequency of the board, are substantially attenuated by the doped region.

10 Claims, 3 Drawing Figures

PRINTED CIRCUIT WIRING BOARD HAVING A DOPED SEMI-CONDUCTIVE REGION TERMINATION

The present invention relates generally to printed circuit wiring boards and more specifically to signal attenuating terminations for signal transmission lines on semiconductor printed circuit wiring boards.

BACKGROUND OF THE INVENTION

The use of signal transmission lines on semiconductor printed circuit wiring boards to carry data pulses from one VLSI chip to another is known in the art. Such a board is described and claimed in R. 0. Carlson, H. H. Glascock, J. A. Loughran and H. F. Webster copending patent application, Ser. No. 635,697, filed July 30, 1984, now U.S. Pat. No 4,541,035, issued Sept. 10, 1985, which is assigned to the assignee of the present application. Sometimes these transmission lines must be terminated at locations where no load is present. The absence of a matched load having the same characteristic impedance as the transmission line can result in pulses being reflected from the unloaded terminating end and returning down the signal transmission line as false pulses.

OBJECTS OF THE INVENTION

It is therefore a primary object of the present invention to provide a semiconductor printed circuit wiring board having signal transmission lines which do not carry reflected pulses from unloaded terminating ends.

It is a further object of the present invention to provide a semiconductor printed circuit wiring board having signal transmission lines with attenuating terminations.

SUMMARY OF THE INVENTION

The foregoing objects of the invention are achieved by providing non-reflective attenuation regions at the unloaded terminating ends of signal transmission lines on a semiconductor printed circuit wiring board for use at a selected operating frequency. Each of these attenuation regions comprises a wedge-shaped, doped region of reduced resistivity in the semiconductor substrate beneath each unloaded terminating end, where it functions as a matched load. Data pulses modulated at the selected operating frequency which reach this end are substantially attenuated by the presence of the doped region underlying the transmission line, thus reducing or substantially eliminating any reflected pulses.

These and other objects of the present invention, together with the features and advantages thereof, will become apparent from the following detailed specification, when considered in conjunction with the accompanying drawings.

DETAILED DESCRIPTION OF THE INVENTION

Figure 1:
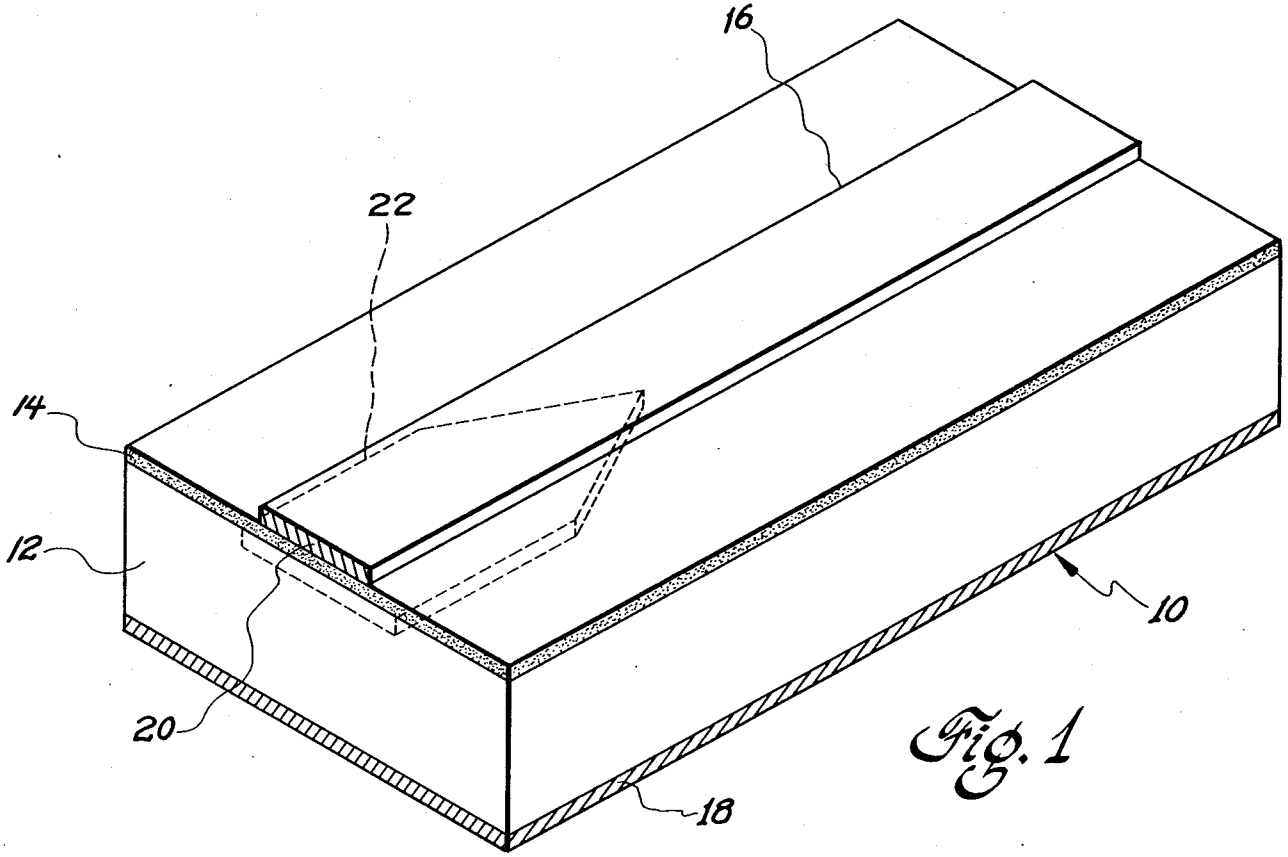
FIG. 1 illustrates a portion of a preferred embodiment of the present invention, as applied to the terminating end of a single signal transmission line.

Referring now to FIG. 1, a portion of a semiconductor printed circuit wiring board 10 is shown, having a silicon substrate 12. In the preferred embodiment, substrate 12 has a high resistivity, on the order of $10^3$ ohm-cm or higher. An insulating layer 14, such as dioxide, is disposed on the upper surface of substrate 12 and a microstrip transmission line 16 overlies oxide layer 14. The oxide layer provides a very high resistance to ground for each transmission line. A ground plane conductor 18 is disposed on the lower surface of substrate 12.

Line 16 has a terminating end 20 which is prone to signal wave reflection in the absence of a matched load. As shown in broken lines in the drawing, a tapered or wedge-shaped, doped region 22 is provided in substrate 12, underlying terminating end 20 of line 16. Doped region 22 provides substantial attenuation for signals modulated at or near the selected operating frequency. Doping of this region with conventional p-type or n-type dopants creates mobile charges in the silicon and thereby reduces the resistivity of the region with respect to the surrounding substrate. A signal in the overlying transmission line causes mobile charges to move and dissipate a substantial portion of the energy of the electric field associated with the signal.

For a given operating frequency there is a particular resistivity of the doped region which will produce maximum attenuation of signal waves modulated at that frequency. Each printed circuit wiring board is tailored for operation at a selected frequency, and doping levels are chosen to provide such maximum attenuation for the selected operating frequency.

Figure 2:
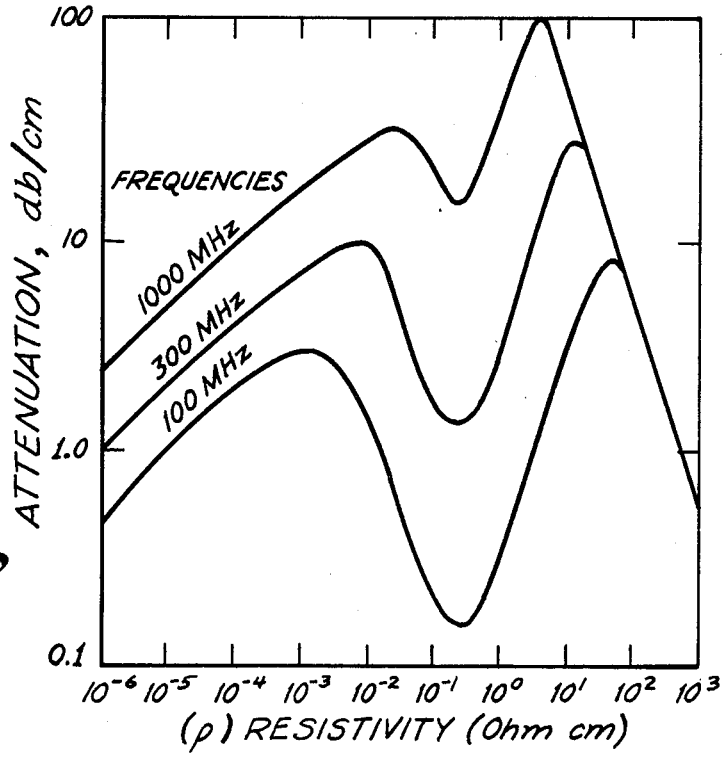
FIG. 2 is a graph showing the attenuation of several different signal frequencies as a function of resistivity of a silicon substrate.
Figure 3:
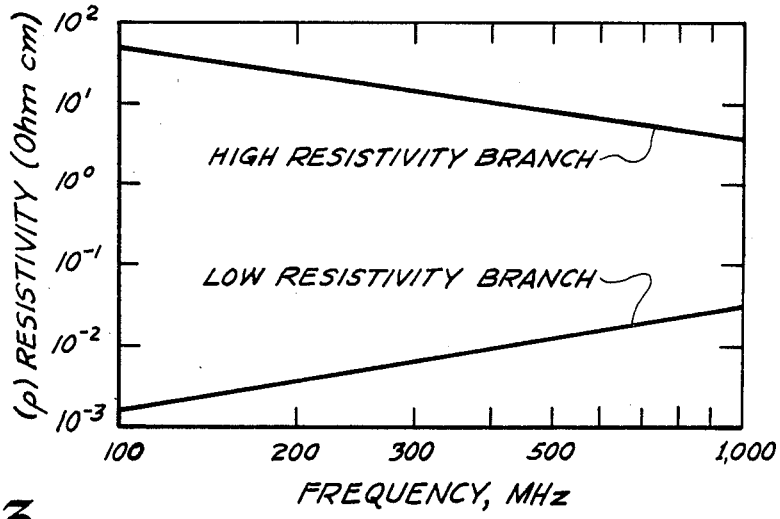
FIG. 3 is a graph showing the silicon substrate resistivities which provide peak attenuation as a function of frequency.

FIG. 2 is a graph of attenuation versus resistivity for operating frequencies of 100, 300 and 1000 MHz respectively. As can be seen from the drawing, there are two attenuation peaks for each curve. FIG. 3 is a graph showing these two resistivity/attenuation peaks as a function of frequency. For high resistivity silicon substrates, i.e. on the order of $10^3$ to $10^6$ ohm-cm, the doping level is chosen for operation in the high resistivity branch. If silicon is used having a resistivity on the order of 0.1 to 1 ohm-cm, doping to conditions of the low resistivity branch is used.

The taper of the wedge pattern is oriented opposite to the direction of signal travel, i.e. it converges in the opposite direction and thus serves to introduce the doped region into the propagation path gradually so that reflections are minimized. The wedge is long enough for the energy of the signal to be substantially attenuated, i.e. on the order of 90% attenuation.

Substrate 12 of the printed circuit wiring board shown in FIG. 1 is preferably fabricated from a silicon wafer. Predetermined region 22 of the substrate, preferably extending to the substrate-insulating layer interface at the upper substrate surface in FIG. 1, is doped, as by diffusion through the upper surface, in the tapered or wedge shape shown. This shape significantly reduces resistivity of the substrate in region 22 with respect to the surrounding substrate. An oxide layer 14 is then grown over the upper substrate surface. Transmission lines, such as line 16, typically of copper or aluminum, are then deposited on the oxide layer, using a suitable film deposition method. The placement of the transmission lines is such that any unloaded terminating end of such line will overlie a doped region 22. A ground plane conductor 18 is deposited on the opposite substrate surface. Because of the relatively large wave attenuation which takes place in each doped region of the silicon substrate, the overall length of each doped region can be made fairly short. This is useful where transmission lines are packed closely together and space is at a premium.

It will be understood that not all signal transmission lines deposited on oxide layer 14 necessarily have unloaded terminating ends. Thus, doped region 22 is placed only beneath an unloaded terminating end, in order to provide a matched load at that location. Further, although the foregoing discussion assumes the existence of microstrip transmission lines, it will be understood by those skilled in the art that the invention will work equally well with stripline and coplanar wave guide transmission lines.

While the present invention has been shown and described with reference to a preferred embodiment, it will be understood that numerous modifications, changes, variations, substitutions and equivalents will now occur to those skilled in the art without departing from the spirit and scope of the invention. For example, gallium arsenide may be employed as the substrate, instead of silicon. Accordingly, it is intended that the invention herein be limited only by the scope of the appended claims.

The invention claimed is:

1. A printed circuit wiring board comprising:

a semiconductor substrate of predetermined resistivity having upper and lower surfaces;

an insulating layer disposed on said upper substrate surfaces;

a ground plane conductor disposed on said lower substrate surface;

at least one signal transmission line disposed on said insulating layer and having an unloaded terminating end; and a doped region included under said insulating layer and located beneath said unloaded terminating end, said doped region having a resistivity lower than the resistivity of the surrounding substrate and being selected to provide peak attenuation of signals modulated at a selected operating frequency, said doped region being electrically isolated from said transmission line by said insulating layer, said doped region having a wedge shape converging in a direction opposite to the direction of signal propagation toward said unloaded terminating end in the overlying signal transmission line, said wedge being of sufficient length to substantially attenuate said signals and thereby prevent reflected pulses from originating at said unloaded terminating end.

2. The printed circuit wiring board of claim 1 wherein said semiconductor substrate comprises silicon.

3. The printed circuit wiring board of claim 1 wherein said semiconductor substrate comprises silicon and said insulating layer comprises silicon dioxide.

4. The printed circuit wiring board of claim 1 wherein said doped region extends into said substrate from the interface of said insulating layer and said substrate.

5. The printed circuit wiring board of claim 1 wherein said doped region extends into said substrate from the interface of said insulating layer and said substrate.

6. The printed circuit wiring board of claim 1 wherein said semiconductor substrate comprises gallium arsenide.

7. The printed circuit wiring board of claim 6 wherein said doped region extends into said substrate from the interface of said insulating layer and said substrate.

8. A method of terminating a signal transmission line deposed on a semiconductor substrate at the characteristic impedance of said line wherever said line has an unloaded terminating end;

said method comprising the steps of:

doping a portion of said substrate in a wedge shaped region and at a concentration effective to reduce resistivity of said region with respect to the surrounding substrate resistivity to a magnitude selected to provide peak attenuation of signals in said transmission line at a selected operating frequency;

applying an insulating layer on the surface of said substrate closest to said wedge-shaped region;

depositing a ground plane conductor on the opposite substrate surface; and depositing said signal transmisson line on said insulating layer such that said unloaded terminating end is positioned over said doped region and is electrically isolated therefrom by said insulating layer;

whereby signals travel in said signal transmission line in a direction toward said unloaded terminating end, and said direction is opposite to the converging taper of said wedge-shaped region, and said signals are substantially attenuated at said unloaded terminating end.

9. The method of terminating a signal transmission line of claim 8 wherein the step of doping said substrate in said wedge-shaped region comprises supplying said dopants through said surface of said substrate closest to said region.

10. The method of terminating a signal transmission line of claim 8 wherein the step of applying an insulating layer on said surface of said substrate closest to said wedge-shaped region comprises growing an oxide layer on said surface closest to said region.

* * * * *